US009360839B2

(12) United States Patent
Imai

(10) Patent No.: US 9,360,839 B2
(45) Date of Patent: Jun. 7, 2016

(54) LIGHT-EXPOSURE UNIT AND IMAGE FORMATION APPARATUS

(71) Applicant: Oki Data Corporation, Tokyo (JP)

(72) Inventor: Manabu Imai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/800,786

(22) Filed: Jul. 16, 2015

(65) Prior Publication Data

US 2016/0085208 A1 Mar. 24, 2016

(30) Foreign Application Priority Data

Sep. 19, 2014 (JP) ..... 2014-191285

(51) Int. Cl.
*G03G 15/00* (2006.01)
*G03G 21/20* (2006.01)
*G03G 15/04* (2006.01)

(52) U.S. Cl.
CPC ..... *G03G 21/206* (2013.01); *G03G 15/04036* (2013.01)

(58) Field of Classification Search
CPC . G03G 15/04036; G03G 21/206; B41J 2/451; B41J 2/45; B41J 2/46
See application file for complete search history.

(56) References Cited

U.S. PATENT DOCUMENTS 4,703,334 A * 10/1987 Mochimaru ..... B41J 2/45 347/130
4,820,013 A * 4/1989 Fuse ..... B41J 2/451 257/778
4,827,290 A * 5/1989 Yoritomo ..... B41J 2/45 257/E27.121
4,829,321 A * 5/1989 Iizuka ..... B41J 2/45 250/227.31
4,875,057 A * 10/1989 Hediger ..... B41J 2/451 347/238
4,913,526 A * 4/1990 Hediger ..... B41J 2/451 355/1
5,036,339 A * 7/1991 Hediger ..... B41J 2/451 346/139 R
5,235,348 A * 8/1993 Avonts ..... B41J 2/45 346/139 R
5,291,039 A * 3/1994 Ogata ..... B41J 2/451 257/712
5,321,429 A * 6/1994 Ono ..... B41J 2/45 174/520
5,376,994 A * 12/1994 Mama ..... G03G 15/011 346/139 R
5,504,516 A * 4/1996 Bax ..... B41J 2/451 347/238
5,506,612 A * 4/1996 Ogata ..... B41J 2/451 347/138
5,751,327 A * 5/1998 De Cock ..... B41J 29/377 165/80.4
6,025,863 A * 2/2000 Nakajima ..... B41J 2/451 347/238
7,020,417 B2 * 3/2006 Nomura ..... B41J 2/45 399/111
7,271,402 B1 * 9/2007 Wu ..... H04N 1/0311 250/208.1
7,720,406 B2 * 5/2010 Tokunaga ..... G03G 15/326 399/98
8,816,357 B2 * 8/2014 Utsugi ..... B41J 2/451 257/13

(Continued)

FOREIGN PATENT DOCUMENTS

JP 08020133 A * 1/1996
JP 08104026 A * 4/1996

(Continued)

*Primary Examiner* — David Bolduc
(74) *Attorney, Agent, or Firm* — Mots Law, PLLC

(57) ABSTRACT

A light exposure unit includes: a board on which to mount light-emitting elements; an optical system configured to cause light emitted from the light-emitting elements to converge; a support member holding the board and the optical system; and a heat sink member configured to dissipate heat from the optical system.

16 Claims, 6 Drawing Sheets

(56) References Cited

U.S. PATENT DOCUMENTS

2001/0040620 A1* 11/2001 Wakisaka ..... B41J 2/451 347/263
2004/0135875 A1* 7/2004 Wakisaka ..... B41J 2/451 347/238
2004/0135876 A1* 7/2004 Ueda ..... B41J 2/451 347/238
2005/0067944 A1* 3/2005 Masuda ..... B41J 2/451 313/501
2007/0110468 A1* 5/2007 Shimazu ..... G03G 15/0258 399/92
2008/0079025 A1* 4/2008 Inoue ..... B41J 2/45 257/205
2009/0047041 A1* 2/2009 Kubo ..... G03G 15/0813 399/222
2009/0225150 A1* 9/2009 Ebisawa ..... B41J 2/45 347/233
2010/0067954 A1* 3/2010 Inoue ..... G03G 15/326 399/220
2010/0086331 A1* 4/2010 Inoue ..... G03G 15/326 399/220
2010/0214390 A1* 8/2010 Tsujino ..... B41J 2/451 347/238
2011/0013926 A1* 1/2011 Yonehara ..... B41J 2/451 399/94
2011/0242261 A1* 10/2011 Komiya ..... B41J 2/451 347/224
2011/0280628 A1* 11/2011 Kim ..... G02B 3/005 399/218
2012/0075403 A1* 3/2012 Nagamine ..... B41J 2/45 347/242
2013/0142538 A1* 6/2013 Miwa ..... G03G 21/206 399/92
2013/0258421 A1* 10/2013 Nakaie ..... H04N 1/0285 358/474

FOREIGN PATENT DOCUMENTS

JP 09011539 A * 1/1997
JP 11058820 A * 3/1999
JP 2005053158 A * 3/2005
JP 2007237551 A * 9/2007
JP 2012-066499 A 4/2012

* cited by examiner

LIGHT-EXPOSURE UNIT AND IMAGE FORMATION APPARATUS

CROSS REFERENCE TO RELATED APPLICATIONS

This application claims priority based on 35 USC 119 from prior Japanese Patent Application No. 2014-191285 filed on Sep. 19, 2014, entitled " LIGHT-EXPOSURE UNIT AND IMAGE FORMATION APPARATUS", the entire contents of which are incorporated herein by reference.

BACKGROUND OF THE INVENTION

1. Field of the Invention

This disclosure relates to an image formation apparatus, and particularly to a structure of a light exposure unit configured to expose an image carrier to light.

2. Description of Related Art

A conventional light exposure unit used in some image formation apparatuses, such as printers, copying machines, facsimile machines and multi-function printers, applies light onto an electrically-charged photosensitive drum, then exposes the photosensitive drum to the light, and thereby forms an electrostatic latent image. For example, the conventional light exposure unit includes: a board on which to mount an LED array; a holder supporting the board; and a rod lens array supported by the holder while facing the LED array, and configured to cause light emitted from the LED array to converge. The light emitted from the LED array mounted on the board passes through the rod lens array, and converges on the surface of the photosensitive drum disposed at a position where the rod lens array forms an image. Thus, the surface of the photosensitive drum is exposed to the light. Thereby, the conventional light exposure unit forms an electrostatic latent image (see Japanese Patent Application Publication No. 2012-66499 (Page 7 and FIG. 3).

SUMMARY OF THE INVENTION

The conventional light exposure unit, however, has a problem in that: the temperature of the optical system, such as the rod lens array, rises due to the influence of peripheral members, such as the LED array which heats, and the photosensitive drum which heats due to things such as friction between the photosensitive drum and other rollers; and a resultant thermal expansion of the optical system changes the optical characteristics of the optical system.

An aspect of the invention is a light exposure unit that includes: a board on which to mount light-emitting elements; an optical system configured to cause light emitted from the light-emitting elements to converge; a support member holding the board and the optical system; and a heat sink member configured to dissipate heat from the optical system.

According to the aspect of the invention, the capability of inhibiting the rise in the temperature of the optical system makes it possible to prevent the optical characteristics from changing due to the rise in the temperature.

DETAILED DESCRIPTION OF THE EMBODIMENTS

Figure 1:
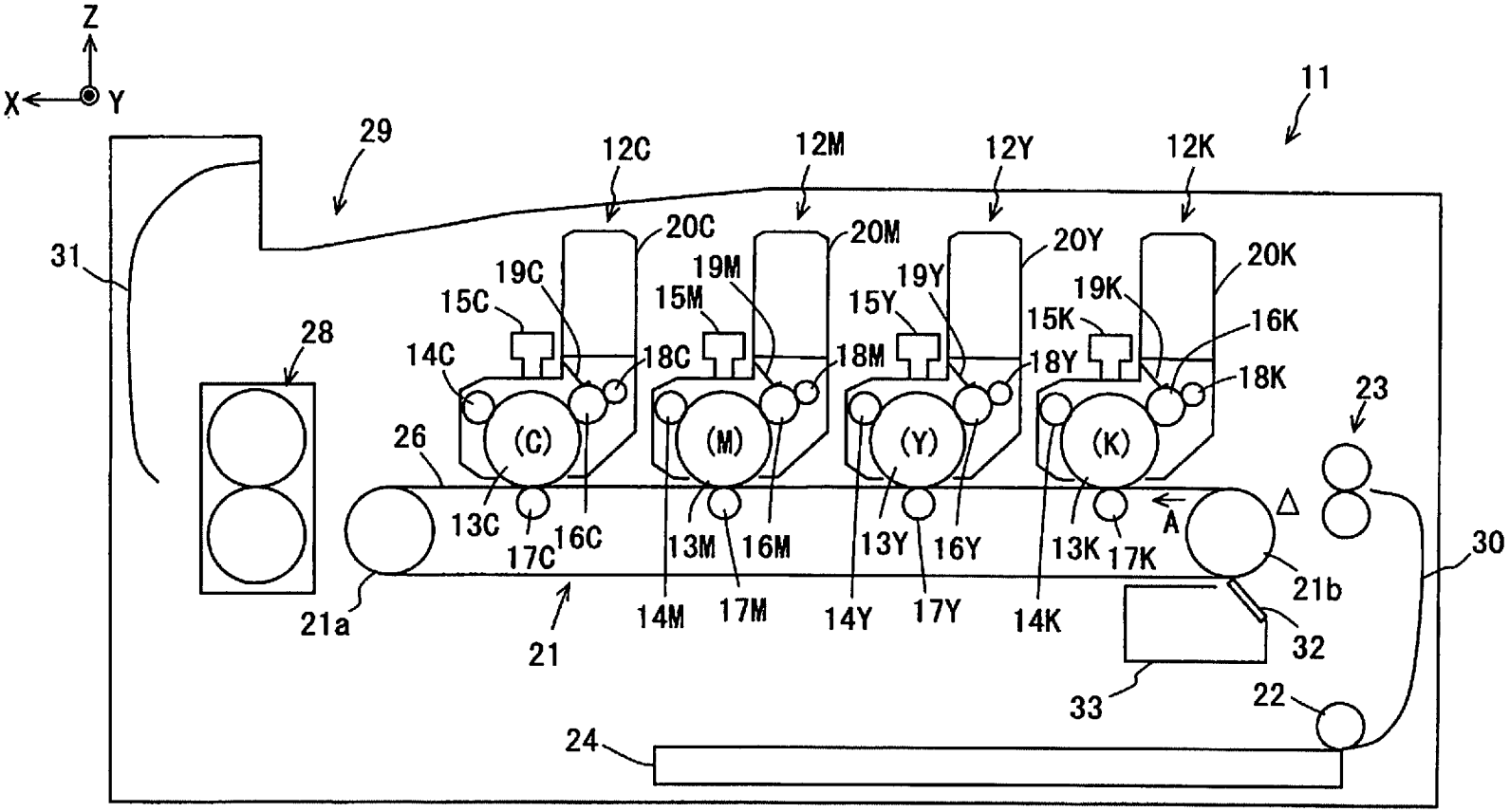
FIG. 1 is a main part configuration diagram schematically illustrating a main part configuration of an image formation apparatus of Embodiment 1 including light-exposure units of the invention, which is viewed from front.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

(Embodiment 1)

FIG. 1 is a main part configuration diagram schematically illustrating a main part configuration of an image formation apparatus of Embodiment 1 including light-exposure units of the invention, which is viewed from front.

Image formation apparatus 11 has a configuration as an electrophotographic color printer, for example. Four mutually-independent image formation units 12K, 12Y, 12M, 12C (each referred to simply as image formation unit 12 in a case where there is no specific need to discriminate one from the other) are arranged in order from the upstream side in a conveyance direction of record sheets 30 as record media (in a direction indicated with arrow A). Image formation unit 12K forms a black (K) image, image formation unit 12Y forms a yellow (Y) image, image formation unit 12M forms a magenta (M) image, and image formation unit 12C forms a cyan (C) image. Incidentally, image formation apparatus 11 is capable of using OHP sheets, envelopes, copy sheets, specialized sheets and the like in addition to record sheets 30.

Image formation unit 12K includes: photosensitive drum 13K; charge roller 14K configured to electrically charge the surface of photosensitive drum 13K evenly; development roller 16 configured to form a toner image by attaching a toner as a developer, albeit not illustrated, to an electrostatic latent image formed on the surface of photosensitive drum 13K; and toner supply roller 18K which is in pressed contact with development roller 16. Similarly, image formation unit 12Y includes photosensitive drum 13Y, charge roller 14Y, development roller 16Y and toner supply roller 18Y; image formation unit 12M includes photosensitive drum 13M, charge roller 14M, development roller 16M and toner supply roller 18M; and image formation unit 12C includes photosensitive drum 13C, charge roller 14C, development roller 16C and toner supply roller 18C. Note that charge rollers 14K, 14Y, 14M, 14C may be referred to as charge roller 14 in a case where there is no specific need to discriminate one from the other.

Toner supply rollers 18K, 18Y, 18M, 18C (each referred to simply as toner supply roller 18 in a case where there is no specific need to discriminate one from the other) are rollers configured to supply color toners, which are supplied from toner cartridges 20K, 20Y, 20M, 20C (each referred to simply as toner cartridge 20 in a case where there is no specific need to discriminate one from the other) detachably attached to the image formation units, and to development rollers 16K, 16Y, 16M, 16C (each referred to simply as development roller 16 in a case where there is no specific need to discriminate one from the other), respectively. Development blades 19K, 19Y, 19M, 19C (each referred to simply as development blade 19 in a case where there is no specific need to discriminate one from the other) are in pressed contact with development rollers 16K, 16Y, 16M, 16C, respectively. Development blade 19 makes the toner, which is supplied from toner supply roller 18, into a thin toner layer on development roller 16. Incidentally, although toner cartridge 20 is designed to be detachably attached to image formation unit 12, toner cartridge 20 and image formation unit 12 may be formed as an integrated unit.

Above photosensitive drums 13K, 13Y, 13M, 13C (each referred to simply as photosensitive drum 13K in a case where there is no specific need to discriminate one from the other) in image formation units 12K, 12Y, 12M, 12C, LED heads 15K, 15Y, 15M, 15C (each referred to simply as LED heads 15 in a case where there is no specific need to discriminate one from the other) are disposed at positions corresponding to photosensitive drums 13K, 13Y, 13M, 13C, respectively. As a light-exposure unit, LED head 15 forms the electrostatic latent image by exposing photosensitive drum 13 to light in accordance with data on the corresponding color image. Incidentally, detailed descriptions are provided for LED head 15 later.

Transfer unit 21 is arranged under photosensitive drums 13 of four image formation units 12. Transfer unit 21 includes transfer rollers 17K, 17Y, 17M, 17C (each referred to simply as transfer roller 17 in a case where there is no specific need to discriminate one from the other), and transfer belt 26 arranged runnable in the direction indicated with arrow A in FIG. 1 while stretched between transfer belt driving roller 21*a* and transfer belt driven roller 21*b*. Transfer roller 17 is disposed in pressed contact with photosensitive drum 13, respectively, with transfer belt 26 interposed in-between. Transfer rollers 17 electrically charge record sheet 30 with a polarity opposite to those of the corresponding toners at their nip portions, and transfer the color toner images, which are formed on corresponding photosensitive drums 13, on record sheet 30 by laying one color toner image over another.

A sheet feeder mechanism configured to supply sheets to transfer belt 26 is arranged in a lower portion of image formation apparatus 11. The sheet feeder mechanism includes hopping roller 22, registration roller pair 23, and sheet container cassette 24.

Image fixation unit 28 is provided on a side where transfer belt 26 delivers record sheet 30. Image fixation unit 28 is a unit including a heater roller and a backup roller, and configured to fix the toners, which are transferred onto record sheet 30, by pressing and heating the toners. Delivery rollers which, albeit not illustrated, are disposed along sheet guide 31, sheet stacker section 29, and the like are provided on the delivery side of image fixation unit 28.

It should be noted that in FIG. 1, the X axis represents a conveyance direction in which record sheet 30 passes image formation units 12K, 12Y, 12M, 12C, the Y axis represents the a direction of the axes of rotation of photosensitive drums 13K, 13Y, 13M, 13C, and the Z-axis represents a direction orthogonal to these two axes. Furthermore, these axial directions coincide with the directions of the X, Y and Z axes illustrated in the other drawings described later. In other words, the X, Y and Z axes in the drawings represent the arrangement directions of the configuration of image formation apparatus 11 illustrated in FIG. 1. Furthermore, in this respect, image formation apparatus 11 is arranged with the Z axis representing the virtually vertical direction.

Descriptions are provided for how image formation apparatus 11 configured as described above performs a printing operation. First of all, hopping roller 22 feeds record sheet 30 from inside sheet container cassette 24, and sends record sheet 30 to registration roller pair 23. Registration roller pair 23 adjusts the skewed feeding of record sheet 30. Subsequently, registration roller pair 23 sends record sheet 30 to transfer belt 26. While running, transfer belt 26 sequentially conveys record sheet 30 to image formation units 12K, 12Y, 12M, 12C.

Meanwhile, in image formation units 12, charge rollers 14 electrically charge the surfaces of photosensitive drums 13. LED heads 15 form the electrostatic latent images on the surfaces of photosensitive drums 13 by exposing the surfaces of photosensitive drums 13 to the light, respectively. The corresponding color toner images are formed on parts of the surfaces of photosensitive drums 13 where the electrostatic latent images are formed by electrically attaching the thin toner layers, which are formed on development rollers 16, to the parts of the surfaces of photosensitive drums 13, respectively. Transfer rollers 17 transfer the corresponding tonner images, which are formed on the photosensitive drums 13, onto record sheet 30 by sequentially laying one toner image over another, and form a multi-color toner image on record sheet 30. After the transfer, a cleaning device, albeit not illustrated, removes toners remaining respectively on photosensitive drums 13.

Transfer belt 26 conveys record sheet 30, on which is the multi-color toner image, to image fixation unit 28. Image fixation unit 28 forms a multi-color image by fixing the multi-color toner image onto record sheet 30. Delivery rollers, albeit not illustrated, convey record sheet 30, on which the multi-color image is formed, along sheet guide 31, and discharges record sheet 30 to sheet stacker section 29. The foregoing process forms the multi-color image on record sheet 30. Incidentally, belt cleaning blade 32 scrapes residual toners, which are attached to the top of transfer belt 26, off transfer belt 26, and belt cleaner container 33 contains the residual toners.

Next, further descriptions are provided for the configuration of LED heads 15. Because the positional relationships between photosensitive drums 13 and corresponding LED heads 15 are the same among image formation units 12 illustrated in FIG. 1, descriptions are provided for the relationship between a photosensitive drum 13 in one color and a corresponding LED head 15 in the same color, as a representative of the relationships.

Figure 2:
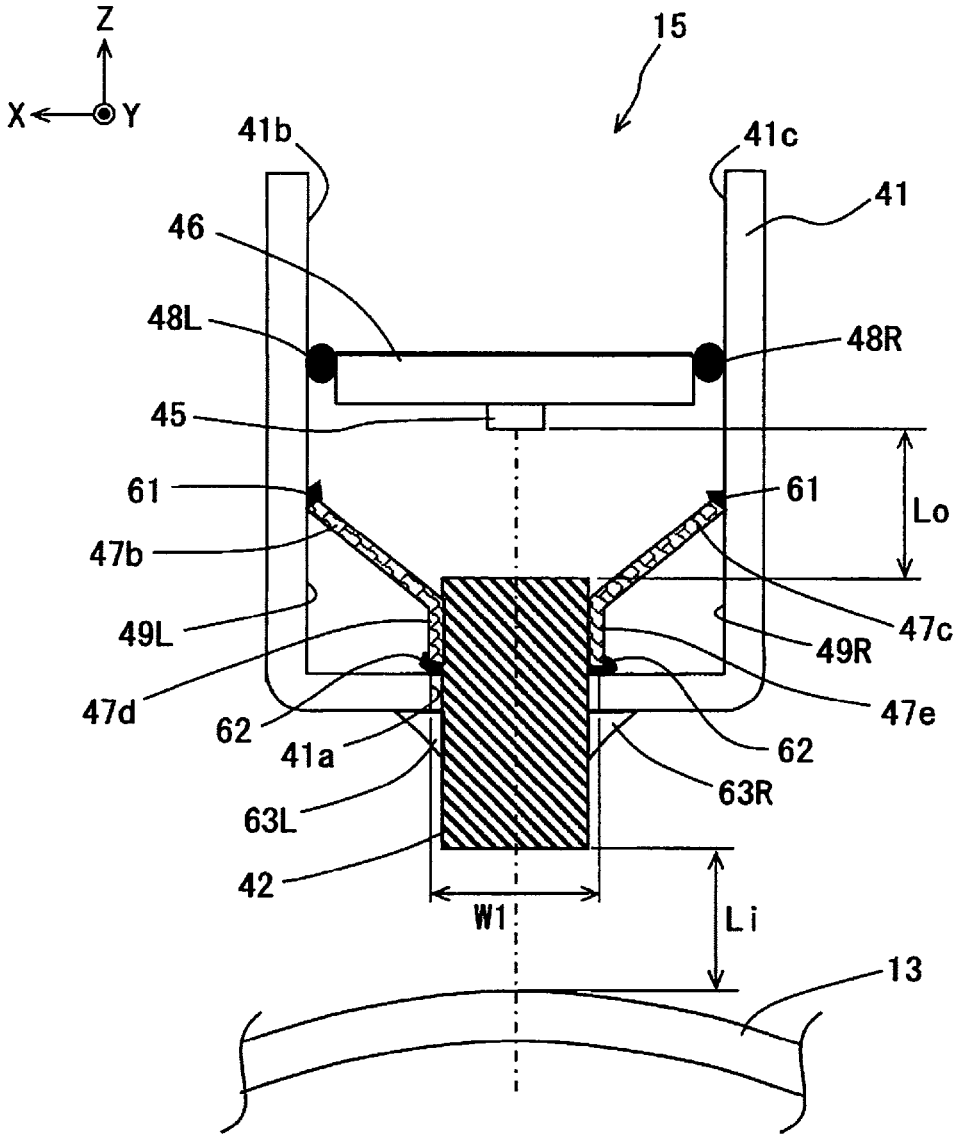
FIG. 2 is a main part configuration diagram of an LED head, which is viewed from the front (a plus side of a Y axis).
Figure 3:
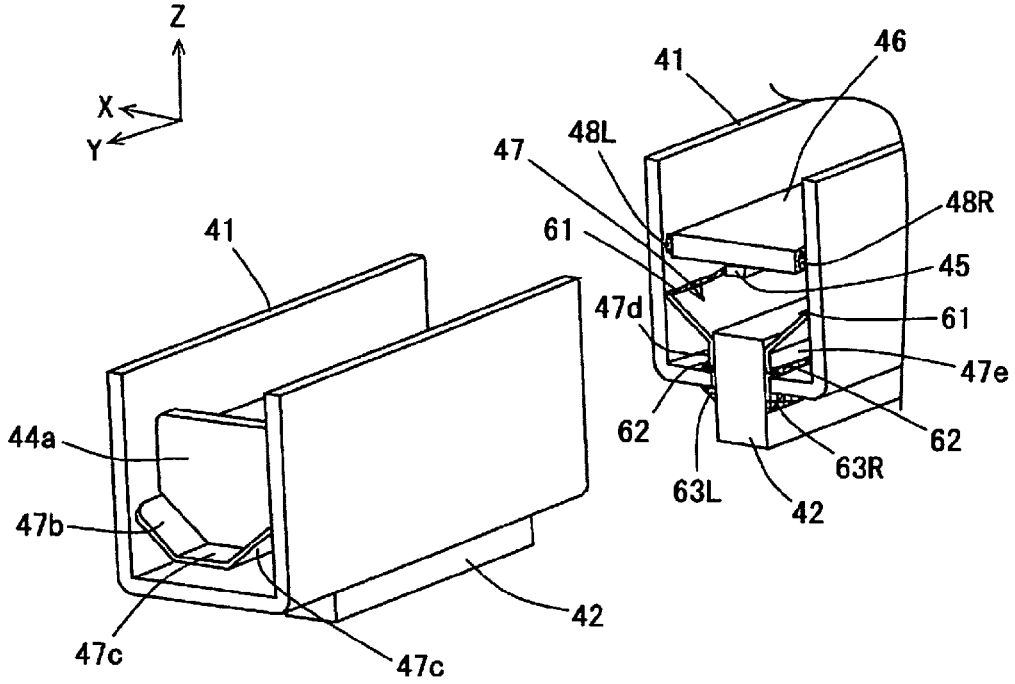
FIG. 3 is an external appearance perspective view of an end portion of the LED head and its vicinity, which are viewed obliquely from above, with the LED head cut across a predetermined portion between the two ends of the LED head in a longitudinal direction of the LED head (in a Y-axis direction) for the purpose of illustrating the inside of the LED head.
Figure 4:
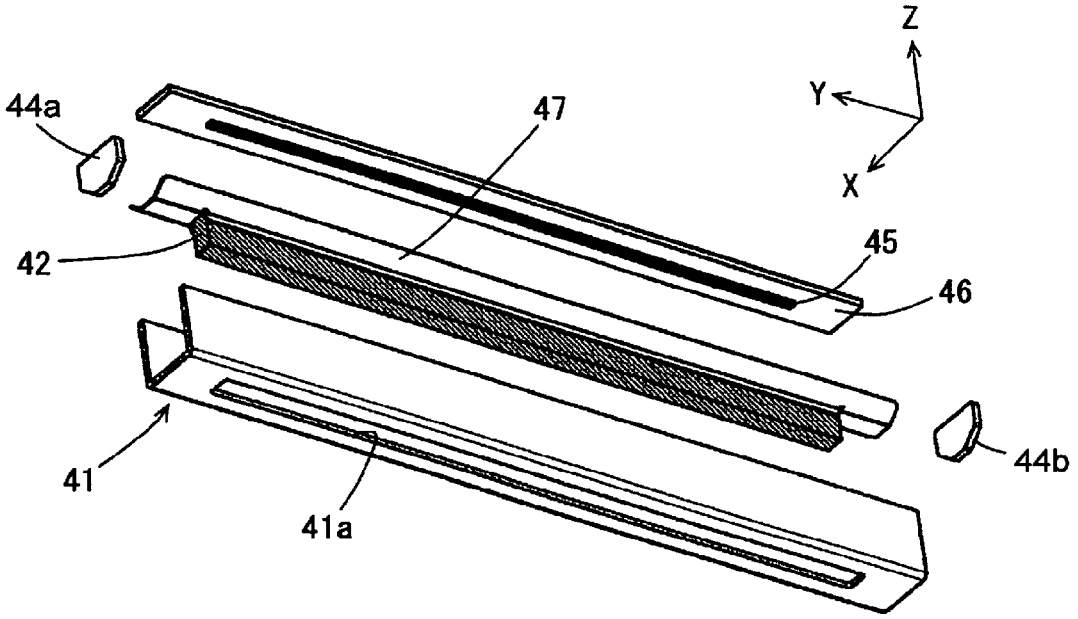
FIG. 4 is an exploded perspective view of the LED head, viewed obliquely from beneath.

FIG. 2 is a main part configuration diagram of LED head 15 as a light-exposure unit, which is viewed from the front (the plus side of a Y axis). FIG. 3 is an external appearance perspective view of an end portion of LED head 15 and its vicinity, which are viewed obliquely from above, with LED head 15 cut across a predetermined portion between the two ends of LED head 15 in a longitudinal direction of LED head 15 (in the Y-axis direction) for the purpose of illustrating the inside of LED head 15. FIG. 4 is an exploded perspective view of LED head 15, which is viewed obliquely from beneath. It should be noted that the frontward, rearward, leftward and rightward direction of LED head 15 are defined as those viewed from the front of LED head 15 illustrated in FIG. 2.

LED head 15 arranged facing photosensitive drum 13 includes holder 41, rod lens array 42, seal plates 44*a*, 44*b*, LED array chip 45, glass epoxy board 46 and heat sink member 47.

LED array chip 45 formed by arraying multiple LEDs as light-emitting elements is mounted on glass epoxy board 46 as a board. LED array chip 45 has a longitudinal (Y-axis) direction length long enough to expose a necessary region of photosensitive drum 13 in the axial direction of photosensitive drum 13. As illustrated in FIG. 4, LED array chip 45 is mounted on glass epoxy board 46. Glass epoxy board 46 includes an electronic component which, albeit not illustrated, is needed to drive LED array chip 45.

Holder 41 as a support member is made from a member having a cross section in a U-letter shape. As described later, holder 41 holds glass epoxy board 46 in its inside. Opening 41*a* extending in the longitudinal direction is formed in a bottom portion of holder 41. Rod lens array 42 as an optical system is inserted in and held by the opening 41*a*. Namely, holder 41 is formed with: a base portion (the bottom portion) supporting rod lens array 42; and a pair of support walls extending from the base portion to hold glass epoxy board 46. The base portion (the bottom portion) of holder 41 is formed with opening 41*a* through which rod lens array 42 is inserted and held. That is, rod lens array 42 includes: a first portion which is provided in the interior of holder 41 and extending from opening 41*a* toward board 46; and a second portion which is provided outside of holder 41 and extending from opening 41*a* toward photosensitive drum 13.

Rod lens array 42 is a component configured to make light, which is emitted from LED array chip 45 including the multiple linearly-arrayed LEDs, converge on the surface of photosensitive drum 13. Rod lens array 42 has the same length in the longitudinal direction as LED array chip 45, for example.

Opening 41*a* is formed in such a position that when rod lens array 42 is fitted into opening 41*a*, the virtual center of holder 41 in a short-side direction of holder 41 (in the X-axis direction) coincides with the center of held rod lens array 42 in the short-side direction (in the X-axis direction). To this end, opening 41*a* is formed such that opening 41*a* is evenly divided into two parts along its center in the short-side direction (in the X-axis direction), and has a width W1 which is slightly wider than that of rod lens array 42.

Rod lens array 42 is fixed to holder 41 at such a position that when LED head 15 is disposed at its predetermined positon in image formation unit 12, a distance from rod lens array 42 to the surface of photosensitive drum 13 facing rod lens array 42, that is to say, an emission distance Li between the light-emitting surface of rod lens array 42 from which to emit light and the surface of photosensitive drum 13 on which the light forms an image, is an optimum distance as regards the viewpoint of the characteristics of rod lens array 42. To this end, and for the purpose of preventing light and foreign objects from entering holder 41, left and right sealants 63L, 63R seal gaps between holder 41 and rod lens array 42.

Figure 5:
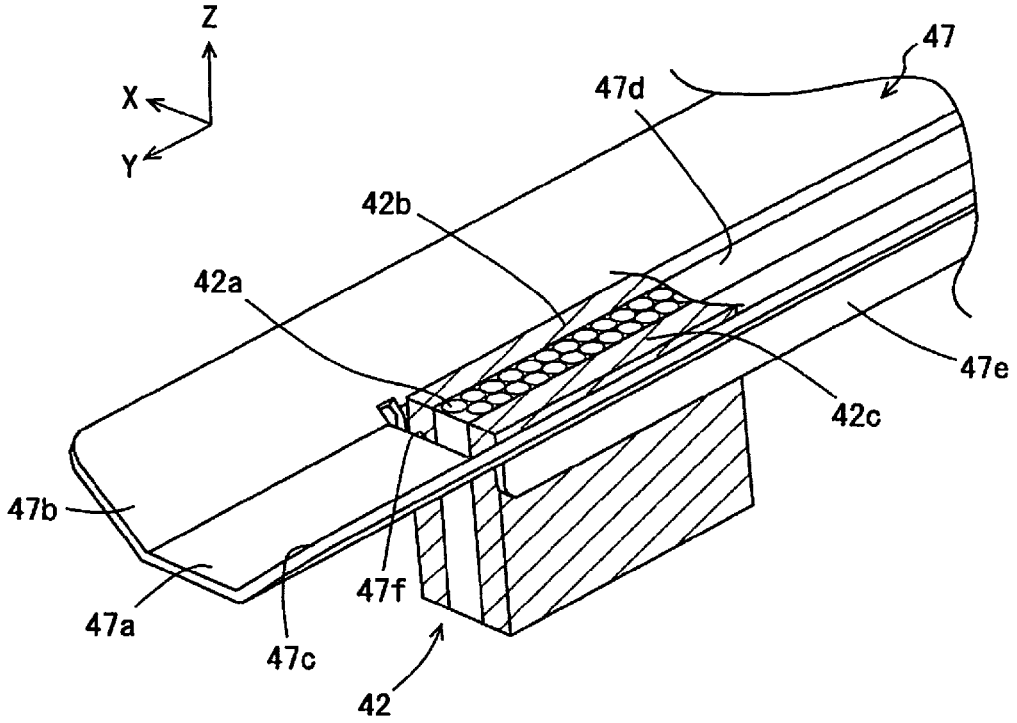
FIG. 5 is a partially magnified view illustrating the appearance of a rod lens array and a heat sink member attached to the rod lens array.

Inside holder 41, as illustrated in FIGS. 2 and 3, heat sink member 47 is attached to rod lens array 42. FIG. 5 is a partially magnified view illustrating how rod lens array 42, and heat sink member 47 attached to rod lens array 42, look. Incidentally, for the purpose of clearly illustrating the attachment configuration, FIG. 5 partially illustrates only an end portion of rod lens array 42 and heat sink member 47 in their longitudinal direction.

As illustrated in FIG. 5, rod lens array 42 is formed from: multiple columnar lens units 42*a* which are staggeringly disposed in two straight lines; and side plates 42*b*, 42*c*, as plate members, arranged surrounding lens units 42*a* from the two sides. In this respect, lens units 42*a* are each made of a glass material or an acrylic resin material, and side plates 42*b*, 42*c* are each made of FRP.

Heat sink member 47 includes: bottom portion 47*a*; and inclination walls 47*b*, 47*c* continuously connected to two ends of bottom portion 47*a*, and extending obliquely upward from the two ends in their respective directions which make inclination walls 47*b*, 47*c* become farther from each other. Long hole 47*f* is formed in bottom portion 47*a*. Long hole 47*f* extends in a longitudinal direction, and an upper portion of rod lens array 42 is fitted in long hole 47*f*. Joint portion 47*d* hanging downward from inclination walls 47*b*, and joint portion 47*e* hanging downward from inclination walls 47*c*, are arranged on the two left and right sides of long hole 47*f*. In addition, heat sink member 47 has a shape in which the length of heat sink member 47 in the longitudinal direction is longer than the length of rod lens array 42 in the longitudinal direction. Long hole 47*f* is formed in bottom portion 47*a* with a predetermined margin interposed between long hole 47*f* and each of the two ends of bottom portion 47*a* in the longitudinal direction. In this respect, heat sink member 47 is made of a material whose thermal conductivity is greater than that of the material of side plates 42*b*, 42*c*.

Inside holder 41, heat sink member 47, formed as described above, is attached to rod lens array 42 and is fixed to holder 41 by: pressing heat sink member 47 downward from above in a way that the upper portion of rod lens array 42 is fitted into long hole 47*f*; and bringing joint portion 47*d* into pressed contact with side plate 42*b* of rod lens array 42, and joint portion 47*e* into pressed contact with side plate 42*c* of rod lens array 42. In this respect, inclination walls 47*b*, 47*c* of heat sink member 47 extend from bottom portion 47*a* to an extent that the tip end portions of inclination walls 47*b*, 47*c* are in contact with left and right inner walls 41*b*, 41*c* of holder 41, respectively.

In this respect, for the purpose of making sure that heat sink member 47 is attached to rod lens array 42, and for the purpose of securing passage spaces, which are described later, silicone sealant 62 is applied to a gap between the tip end portion of joint portion 47*d* and side plate 42*b* of rod lens array 42, as well as to a gap between the tip end portion of joint portion 47*e* and side plate 42*c* of rod lens array 42. Silicone sealant 61 is applied to a gap between the tip end portion of inclination wall 47*b* and left inner wall 41*b* of holder 41, as well as to a gap between the tip end portion of inclination wall 47*c* and right inner wall 41*c* of holder 41. Thereby, inside holder 41, and passage spaces 49L, 49R enabling air to circulate therein, are formed on the two left and right sides of rod lens array 42.

Glass epoxy board 46 is fixed to the inside of holder 41 in a direction in which LED array chip 45 mounted on glass epoxy board 46 faces rod lens array 42. To this end, glass epoxy board 46 is arranged in the inside of holder 41 such that: the center of rod lens array 42 in the short-side direction (in the X-axis direction) coincides with the optical axis of LED array chip 45; and the incidence distance Lo between the surface of LED array chip 45, from which light is emitted, and the end surface of rod lens array 42, onto which incident light falls, has a relationship with the emission distance Li described above. That relationship is expressed by:

$$Lo=Li.$$

Glass epoxy board 46 is fixed to the inside of holder 41 with: adhesive 48L applied to a gap between one end portion of glass epoxy board 46 in the short-side direction (in the X-axis direction) and left inner wall 41*b* of holder 41; and adhesive 48R is applied to a gap between the other end portion of glass epoxy board 46 and right inner wall 41*c* of holder 41.

Accordingly, the gap large enough to absorb error in the installation of components in the production process is provided between glass epoxy board 46 and each of left and right inner walls 41*b*, 41*c* of holder 41.

In addition, a pair of seal plates 44*a*, 44*b* configured to prevent light and foreign objects from entering a space surrounded by holder 41, glass epoxy board 46, heat sink member 47 and rod lens array 42 are provided such that, as illustrated in FIGS. 3 and 4, seal plates 44*a*, 44*b* are arranged in contact with the two end portions of glass epoxy board 46, left and right inner walls 41*b*, 41*c* of holder 41, and the upper surface of heat sink member 47; and thereby, seal plates 44*a*, 44*b* seal the inner space.

Figure 6:
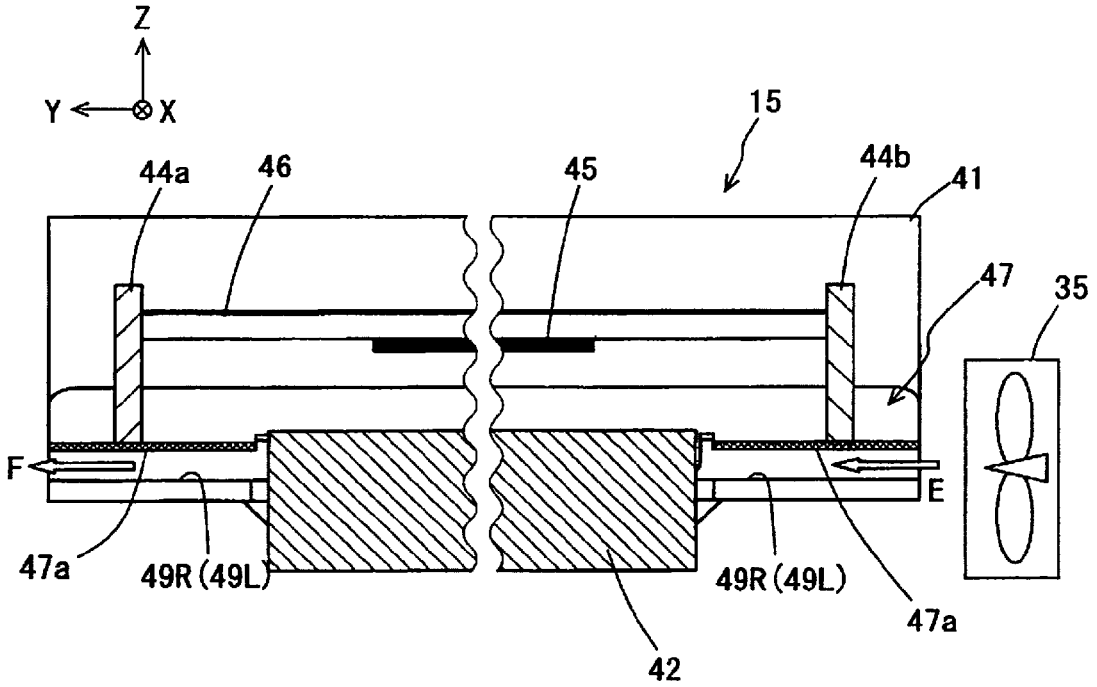
FIG. 6 is an operation explanatory diagram illustrating a positional relationship between a fan included in the image formation apparatus and the LED head which as illustrated in FIG. 1. The fan is disposed at a predetermined position inside the image formation apparatus.

FIG. 6 is an operation explanatory diagram illustrating a positional relationship between fan 35 installed in image formation apparatus 11 and LED head 15 configured as described above which as illustrated in FIG. 1, is disposed at the predetermined position inside image formation apparatus 11. Incidentally, FIG. 6 partially illustrates the two end portions of LED head 15 in the longitudinal direction and their vicinities with a central portion of LED head 15 in the longitudinal direction omitted from FIG. 6.

As illustrated in FIGS. 1 and 6, image formation apparatus 11 is configured such that: on one side of each of four LED heads 15 disposed at their respective predetermined positions inside image formation apparatus 11, fan 35 is placed at a position facing passage spaces 49L, 49R of LED head 15; and thereby, cooling air sent in by fan 35 flows through passage spaces 49L, 49R.

Figure 7:
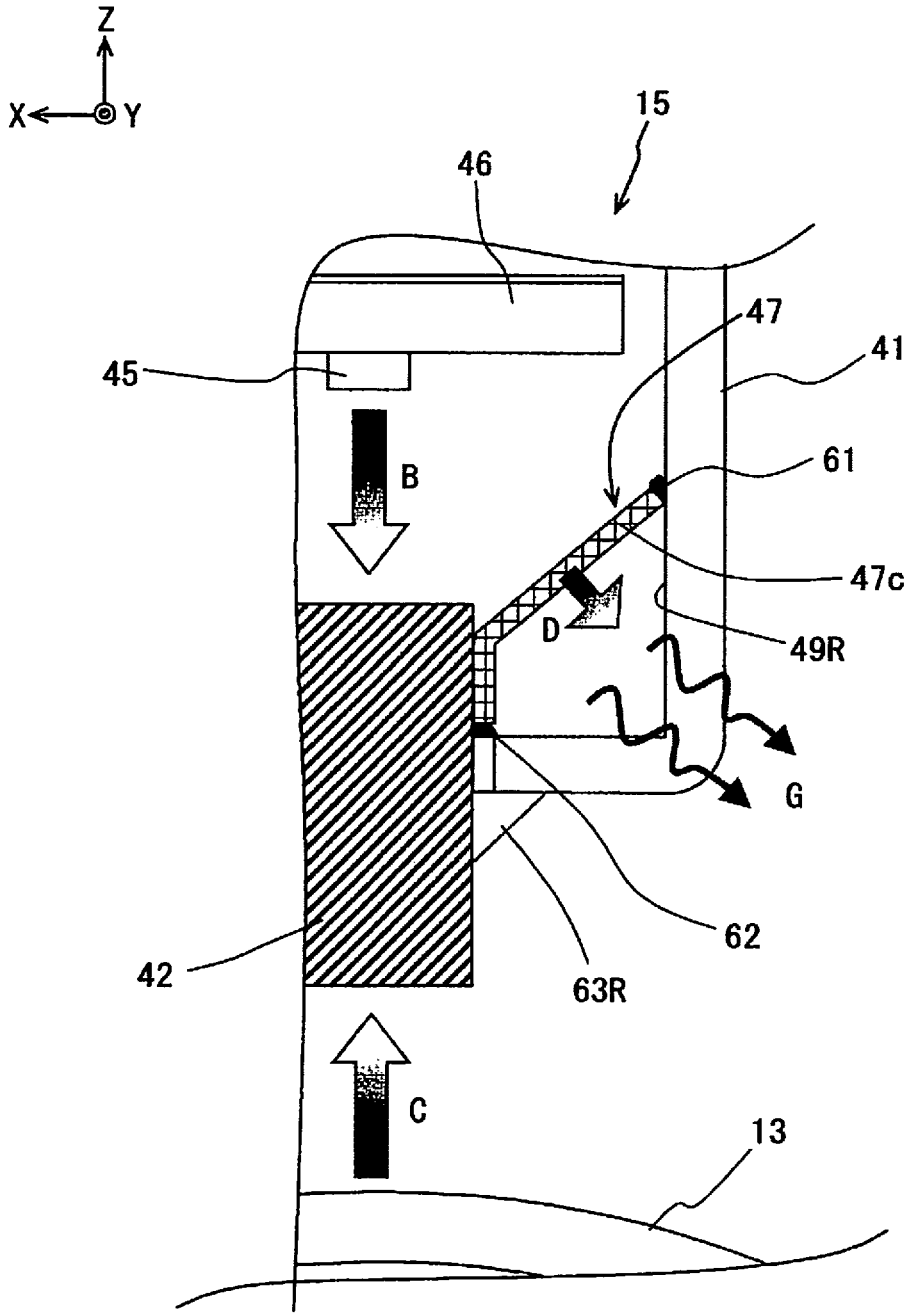
FIG. 7 is a partially magnified view of the LED head which is used to explain the cooling operation.

Referring to FIGS. 6 and 7, further descriptions are provided for how LED head 15 in the foregoing configuration performs a cooling operation. Incidentally, FIG. 7 is a partially magnified view of LED head 15 which is used to explain the cooling operation.

While image formation apparatus 11 is performing the printing operation, rod lens array 42 is influenced by heat generation due to the light exposure of LED array chip 45, and by the heat generation of photosensitive drum 13 which occurs due to the contact between photosensitive drum 13 with charge roller 14, development roller 16, the cleaning device (not illustrated) and the like. A temperature gradient arrow B in FIG. 7 indicates a direction of the heat transfer from LED array chip 45 to rod lens array 42, while a temperature gradient arrow C in FIG. 7 indicates a direction of the heat transfer from photosensitive drum 13 to rod lens array 42. A temperature gradient arrow D in FIG. 7 indicates a direction of heat transfer from heat sink member 47. In addition, the gradation of each of the temperature gradient arrows B, C, D provides a sketch of temperature distribution. A darker gradation indicates a higher temperature.

If the temperature of rod lens array 42 rises due to these heat generations, a change may occur in the dimension of rod lens array 42 in an optical axis direction of rod lens array 42 (in the Z-axis direction). As a result, rod lens array 42 may become unable to keep the foregoing relationship which is expressed with Lo (incidence distance)=Li (emission distance).

Accordingly, rod lens array 42 would change its own optical characteristics, such as the focal position, and the change in the optical characteristics would be reflected as a defected print on a sheet.

In contrast, image formation apparatus 11 of the invention inhibits the rise in the temperature of rod lens array 42 by sending the cooling air into LED head 15 which, as illustrated in FIG. 6, is arranged in the predetermined position inside image formation apparatus 11 (FIG. 1), by use of fan 35 arranged facing LED head 15.

To put it more concretely, as indicated with arrow E, the cooling air sent to LED head 15 by fan 35 flows into the openings of passage spaces 49L, 49R which are formed in the left and right portions of rod lens array 42. After passing through passage spaces 49L, 49R, the cooling air flows out of the openings of passage spaces 49L, 49R on the opposite side, as indicated with arrow F. In this respect, the temperature of the cooling air sent by fan 35 is lower than the temperature of the inside of LED head 15, and air taken in from the outside of image formation apparatus 11, for example, is used as the cooling air.

The temperature of passage space 49R is always kept lowest in the inside of LED head 15 by heat convection which, as illustrated in FIG. 7, occurs due to the cooling air flowing through the passage space (in FIG. 7, arrows G represents the cooling air flowing out of passage space 49R). It should be noted that although referring to FIG. 7, the cooling operation by right passage space 49R is explained as an example, left passage space 49R performs the same cooling operation.

Thereby, the cooling air takes heat away from heat sink member 47 whose thermal conductivity is high, and which forms a half of the surrounding wall of passage space 49R (49L). Accordingly, heat sink member 47 cools down. Furthermore, heat sink member 47 thus cooling down takes heat away from rod lens array 42 connected to heat sink member 47. Accordingly, rod lens array 42 cools down. This inhibits the rise in the temperature of rod lens array 42 which is a result of the influence of the heat generation due to the light exposure of LED array chip 45, and the heat generation of photosensitive drum 13.

Figure 8:
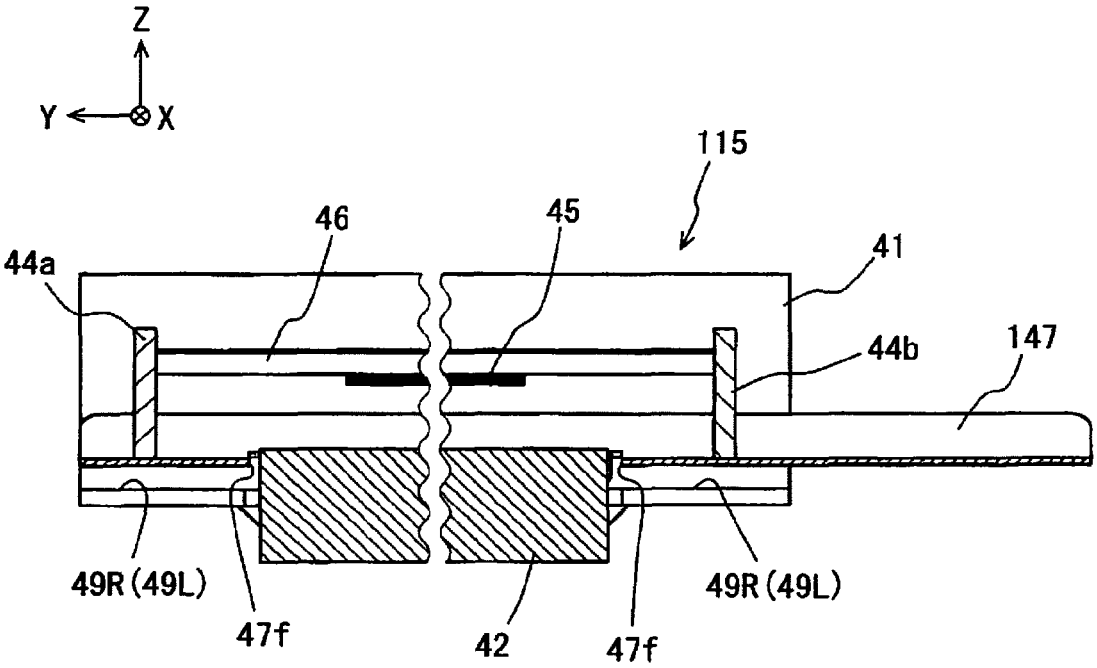
FIG. 8 is a main part configuration diagram of an LED head of Modification 1.

Referring to a main part configuration diagram of FIG. 8, descriptions are provided for Modification 1 of the embodiment.

LED head 115 of Modification 1 employs heat sink plate 147 instead of heat sink member 47 of LED head 15 of the embodiment illustrated in FIG. 6. In heat sink plate 147, a distance between long hole 47*f* and one or both of the two ends of heat sink plate 147 in the longitudinal direction is made longer. FIG. 8 illustrates heat sink plate 147 in which the distance between long hole 47*f* and one of the two ends is made longer.

This makes the end portion (s) of heat sink plate 147 extend outward beyond LED head 115, and accordingly enhances the cooling efficiency of heat sink plate 147 in proportion to an increase in the cooling surface of heat sink plate 147. In addition, the portion (s) of heat sink plate 147 which extendedly exists outside LED head 115 cools down, because the portion (s) thereof is not influenced by the heat generation inside LED head 115, or the heating generation of image formation unit 12. For this reason, a highly-efficient cooling structure can be constructed.

It should be noted that although the embodiment shows the example where the cooling air flows through passage space 49R (49L), the embodiment is not limited to this. For example, coolant may flow through passage space 49R (49L). In addition, although by using the open end portions of holder 41, the embodiment makes the cooling air flow into one open end portion and out of the other open end portion, the embodiment is not limited to this. The embodiment may be carried out in various modes, for example in a mode in which: the end portions of holder 41 are closed; and an inlet is formed in one end side of heat sink member 47, while an outlet is formed in the other end side of heat sink member 47.

As described above, LED head 15 of the embodiment, and image formation apparatus 11 employing LED head 15 are capable of cooling heat sink member 47 which forms the passage spaces and is in contact with rod lens array 42, and is accordingly capable of preventing any deterioration in the printing quality, which would otherwise occur due to the change in the optical characteristics of rod lens array 42, by inhibiting the rise in the temperature of rod lens array 42 which results from the influence of the heat generation due to the light exposure of LED array chip 45 and the heat generation of photosensitive drum 13, and by inhibiting any change in the optical characteristics, such as a shift in the focal position which stems from the rise in the temperature.

Furthermore, since heat sink member 47 separates LED array chip 45 from passage spaces 49R, 49L, it is possible to prevent dust in passage spaces 49R, 49L from sticking to LED array chip 45.

INDUSTRIAL APPLICABILITY

The embodiment is explained by using the color printer as the image formation apparatus, but the invention is applicable to: monochrome printers; copying machines; facsimile machines, multi-function printers combining a monochrome printer, a copying machine and a facsimile machine; and the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A light exposure unit comprising:
a board on which to mount light-emitting elements;
an optical system configured to cause light emitted from the light-emitting elements to converge;
a support member holding the board and the optical system; and
a heat sink member configured to dissipate heat from the optical system, wherein
the support member includes: a base portion supporting the optical system with the optical system penetrating through the base portion; and a pair of support walls extending from the base portion and configured to support the board, such that the light-emitting elements of the board face the optical system,
the optical system includes a first portion which extends from the base portion toward the board in the interior of the support member, and
the heat sing member includes a connection wall connecting the first portion of the optical system and one of the support walls of the support member.

2. The light exposure unit according to claim 1, wherein at least the heat sink member and the support member form a space which extends in a longitudinal direction of the support member.

3. The light exposure unit according to claim 2, wherein the space is configured as a passage for a fluid.

4. The light exposure unit according to claim 1, wherein the heat sink member is longer in the longitudinal direction of the support member than the support member.

5. The light exposure unit according to claim 1, wherein
the optical system includes a lens unit, and a pair of plate members holding the lens unit between the plate members, and
the heat sink member is made of a material whose thermal conductivity is greater than that of the plate members, and is in contact with the plate members.

6. The light exposure unit according to claim 5, wherein the lens unit is made of a plastic material.

7. An image formation apparatus comprising the light exposure unit according to claim 1.

8. The image formation apparatus according to claim 7, further comprising a fan configured to cool the heat sink member.

9. The light exposure unit according to claim 1, wherein
the support member is formed in a shape to partially surround a part of the optical system and the board.

10. The light exposure unit according to claim 1, wherein
the base portion of the support member is formed with an opening which the optical system is inserted through and is held by.

11. The light exposure unit according to claim 1, wherein
the support member includes the base portion and the pair of the support walls to have a U-shaped cross section.

12. The light exposure unit according to claim 1, wherein
the connection wall is not orthogonal to and inclined with respect to the one of the support walls.

13. The light exposure unit according to claim 1, wherein
the base portion of the support member, the one of the support walls of the support member, the connection wall, and the first portion of the optical system define a closed cross-section space, and
the closed cross-section space extends in a longitudinal direction of the board.

14. A light exposure unit comprising:
a board on which to mount light-emitting elements;
an optical system configured to cause light emitted from the light-emitting elements to converge;
a support member holding the board and the optical system; and
a heat sink member configured to dissipate heat from the optical system, wherein
the support member includes: a base portion supporting the optical system with the optical system penetrating through the base portion; and a support wall extending from the base portion and configured to support the board, such that the light-emitting elements of the board face the optical system,
the heat sink member includes a connection wall connecting the optical system and the support wall of the support member.

15. The light exposure unit according to claim 14, wherein
the optical system includes a first portion which extends from the base portion toward the board in the interior of the support member, and
the connection wall connects the first portion of the optical system and the support wall of the support member.

16. The light exposure unit according to claim 15, wherein
the connection wall connects an outer surface of the first portion of the optical system and an inner lateral surface of the support wall of the support member.

* * * * *